US005220240A

United States Patent [19]

Ohoshi et al.

[11] Patent Number: 5,220,240

[45] Date of Patent: Jun. 15, 1993

[54] PLANAR DISPLAY APPARATUS

[75] Inventors: Toshio Ohoshi; Akira Nakayama, both of Tokyo; Junichi Inoue, Ibaragi; Masaru Yamaguchi, Tokyo, all of Japan

[73] Assignee: Sony Corporation, Tokyo, Japan

[21] Appl. No.: 631,148

[22] Filed: Dec. 20, 1990

[30] Foreign Application Priority Data

Dec. 21, 1989 [JP] Japan ..... 1-331593
Dec. 21, 1989 [JP] Japan ..... 1-331594

[51] Int. Cl.[5] ..... H01J 29/82

[52] U.S. Cl. ..... 313/422; 313/426; 313/427; 313/439; 313/438; 313/456; 313/460; 313/103 R

[58] Field of Search ..... 313/422, 427, 426, 456, 313/460, 432, 439, 438, 103 R, 105 R

[56] References Cited

U.S. PATENT DOCUMENTS 4,090,104 5/1978 Vann et al. ..... 313/422
4,879,496 11/1989 Knapp et al. ..... 313/422 X
4,881,005 11/1989 Morimoto et al. ..... 313/422
4,900,981 2/1990 Yamazaki et al. ..... 313/422

FOREIGN PATENT DOCUMENTS 0115134 6/1985 Japan .
0017355 1/1989 Japan .

*Primary Examiner*—Donald J. Yusko
*Assistant Examiner*—Ashok Patel
*Attorney, Agent, or Firm*—Hill, Steadman & Simpson

[57] ABSTRACT

A planar display apparatus with a fluorescent screen formed on the inner surface of a front panel in a planar tube body. An electron gun is disposed at a position deviated in a vertical scanning direction from a region opposite the fluorescent screen, and a vertical deflecting electrode composed of a plurality of parallel electrodes is disposed at an opposite portion relative to the fluorescent screen on the side of a back panel opposed to the front panel of the planar tube body. In a space between the vertical deflecting electrode and the fluorescent screen, there is disposed an electrode structure having at least an electron lens scanning electrode composed of a plurality of parallel electrodes, a splitting electrode for splitting an electron beam from the electron gun into a plurality of beams, a modulating electrode, and horizontal deflection electrodes.

16 Claims, 11 Drawing Sheets

PLANAR DISPLAY APPARATUS

1. FIELD OF THE INVENTION

The present invention relates to a planar display apparatus adapted for visually representing a variety of images thereon.

2. DESCRIPTION OF THE PRIOR ART

There are known various proposals with regard to planar display apparatus of the panel type. For example, in Japanese Patent Laid-open No. Hei 1 (1989)-173555 a panel type cathode-ray tube is disclosed with a secondary electron multiplier. It is currently required to apply such a device to a wide-area display apparatus with a 40-inch screen or the like.

In a planar display apparatus of the type mentioned, as in the cathode-ray tube disclosed in Japanese Patent Laid-open No. Hei 1 (1989)-173555, a plurality of cathodes or filaments are provided, and thermions generated therefrom are moved toward a fluorescent screen while being modulated in accordance with a display signal, thereby causing emission of light from individual portion of the fluorescent screen to execute a desired visual representation. In such an arrangement where a plurality of cathodes (or filaments) are disposed to share emission of light from the individual portions of the fluorescent screen, there may arise a problem that uniform visual representation of an image fails to be achieved due to variations in the characteristics of the individual cathodes.

An improved construction is disclosed in Japanese Patent Laid-open No. Sho 60 (1985)-115134 where, in place of the above-described plural cathodes (filaments), a single cathode is provided for display of an image. In this improvement, however, it is prone to occur that the focusing condition differences derived from inequalities of the electron beam trajectory distances with regard to the entire positions on the screen are rendered extremely conspicuous in accordance with a dimensional increase of the screen, hence inducing a deterioration of the image quality uniformity.

Furthermore, with a dimensional increase of the screen area in such a display apparatus, it becomes necessary to take into consideration the capability of withstanding any external pressure, such as atmospheric pressure, to the planar tube body. For this purpose, in the above planar cathode-ray tube, a curb-shaped electrode is provided to retain the space between the front panel and the back panel of the planar tube body in opposed fashion relative to each other, so as to ensure a withstanding capability which properly maintains the space between the two panels. In this case, there arises another problem of nonuniformity in the electron beams that may be derived from some electric field distortion and so forth due to the existence of such a curb-shaped electrode. Therefore, a complete elimination of image deterioration is not exactly attained by such a curb-shaped electrode which serves as a support member for the two panels in the planar tube body.

An improved construction is disclosed in Japanese Patent Laid-open No. Sho 60 (1985)-115134 where, in place of the above-described plural cathodes (filaments), a single cathode is provided for display of an image. In this improvement, however, no consideration is given with regard to the capability of withstanding an external pressure in displaying an image on the aforementioned large (wide) screen.

SUMMARY OF THE INVENTION

It is an object of the present invention to provide a novel planar display apparatus which is capable of solving the problems of brightness nonuniformity on the display screen derived from a dimensional increase of the screen area, and further of solving another problem of the mechanical strength of the planar tube body against an external pressure, such as atmospheric pressure.

Another object of the present invention is to minimize deterioration of the display image quality that may be caused with a dimensional increase of the screen in a planar display apparatus.

In a first embodiment of the present invention, as shown in a front view of FIG. 1, a side view of FIG. 2 and a schematic sectional view of FIG. 3, a fluorescent screen is formed on the inner surface of a front panel in a planar tube body, and an electron gun is disposed at a position deviated in a vertical scanning direction from an opposite portion of the fluorescent screen.

A vertical deflecting electrode, which is composed of a plurality of parallel electrodes extending in a horizontal scanning direction, is disposed opposite to the fluorescent screen and on the inner surface of a back panel opposed to the front panel of the planar tube body.

In the space between the vertical deflecting electrode and the fluorescent screen, there is disposed an electrode structure which includes at least an electron lens scanning electrode composed of a plurality of parallel electrodes extending in the horizontal scanning direction, a splitting electrode for splitting an electron beam from an electron gun into a plurality of beams, a modulating electrode and a horizontal deflecting electrode.

A plurality of high-resistance support walls are provided at a predetermined pitch between the electrode structure and the back panel for pressing the electrode structure toward the front panel so as to retain the space between the front panel and the back panel. The plate surfaces of such support walls extend in the vertical scanning direction orthogonally to both panels.

The electron beam emitted from the electron gun is introduced into the space between the electrode structure and the vertical deflecting electrode substantially parallel to the two panels in such a manner that the sectional shape of the beam becomes substantially band-like or linear along the horizontal scanning direction.

In this specification, the horizontal and vertical scanning directions are defined to signify two mutually orthogonal directions on the screen, and not to indicate physical horizontal and vertical directions.

In the construction mentioned, the band-like or linear electron beam emitted from the electron gun and introduced along the space between the electrode structure and the vertical deflecting electrode is deflected by an electric field generated toward the electrode structure when a required voltage is applied sequentially to the parallel electrodes of the vertical deflecting electrode in synchronism with the vertical scanning period, whereby the electron beam is caused to perform vertical scanning. The electron beam thus vertically deflected is split by the splitting electrode into a plurality of beams, which are then directed toward the fluorescent screen.

Vertical scanning is thus performed by shifting the position of a deflecting electric field, and simultaneously therewith, a focusing lens system for focusing the electron beam introduced into the above-described vertical electric field is formed by the cooperation of the vertical deflecting electrode and the parallel electrode of the electron lens scanning electrode. The lens system thus formed is moved for scanning in conformity with the shift of the deflecting electrode with respect to the deflecting electric field in the region far from at least the electron gun.

Due to such functioning, even in the large-screen display apparatus, the magnification of the electron lens system can be rendered uniform inclusive of the vertical deflecting position far from the electron gun, thereby equalizing the focus state to consequently attain satisfactory uniformity of the image quality.

Since the planar display apparatus of the present invention employs a single electron beam, brightness nonuniformity can be averted in comparison with an ordinary example where individual portions of the screen are shared by beams emitted from different cathodes.

In a second embodiment of the present invention, as shown in FIGS. 11, 12, 13, 14, and 15, a fluorescent screen is formed on the inner surface of a front panel in a planar tube body, and an electron gun is disposed at a position deviated in a vertical scanning direction from an opposite portion to the fluorescent screen.

A vertical deflecting electrode, which is composed of a plurality of parallel electrodes extending in a horizontal scanning direction, is disposed opposite to the fluorescent screen and on the inner surface of a back panel opposed to the front panel of the planar tube body.

In the space between the vertical deflecting electrode and the fluorescent screen, there is disposed an electrode structure which includes at least a splitting electrode for splitting an electron beam from an electron gun into a plurality of beams, a modulating electrode, and a horizontal deflecting electrode.

The electron beam emitted from the electron gun is introduced into the space between the electrode structure and the vertical deflecting electrode substantially parallel to the panels in such a manner that the sectional shape of the beam becomes substantially band-like or linear along the horizontal scanning direction.

In this example also, the horizontal and vertical scanning directions are defined to signify two mutually orthogonal directions on the screen, and not to indicate physical horizontal and vertical directions.

In the construction mentioned, the band-like or linear electron beam emitted from the electron gun and introduced along the space between the electrode structure and the vertical deflecting electrode is deflected by an electric field generated toward the electrode structure when a required voltage is applied sequentially to the parallel electrodes of the vertical deflecting electrode in synchronism with the vertical scanning period.

The above and other features and advantages of the present invention will become apparent from the following description which will be given with reference to the illustrative accompanying drawings.

DESCRIPTION OF THE PREFERRED EMBODIMENTS

Hereinafter an exemplary planar display apparatus according to a first embodiment of the present invention will be described in detail with reference to the accompanying drawings.

In this embodiment, a planar tube body 1 is employed. The planar tube body 1 is provided with at least a front panel 1F and a back panel 1B which have a light transmitting property and are hermetically sealed through peripheral side walls 1S. Denoted by 21 is a chip-off pipe for sealing up the planar tube body after evacuation thereof. Such front panel 1F, back panel 1B and peripheral side walls 1S are each composed of a glass plate or the like and are bonded to one another with glass frit.

The inner surface of the front panel 1F is coated with a fluorescent screen 2 direction, or another transparent plate coated therewith is provided, and the fluorescent screen 2 is metal-backed by evaporation of an aluminum film or the like in a customary manner.

A vertical deflecting electrode 3 is provided either directly on the back panel 1B or is provided on another plate, and an electrode structure 7 is provided between the vertical deflecting electrode 3 and the fluorescent screen 2, while being spaced apart by a predetermined distance from the vertical deflecting electrode 3.

Figure 3:
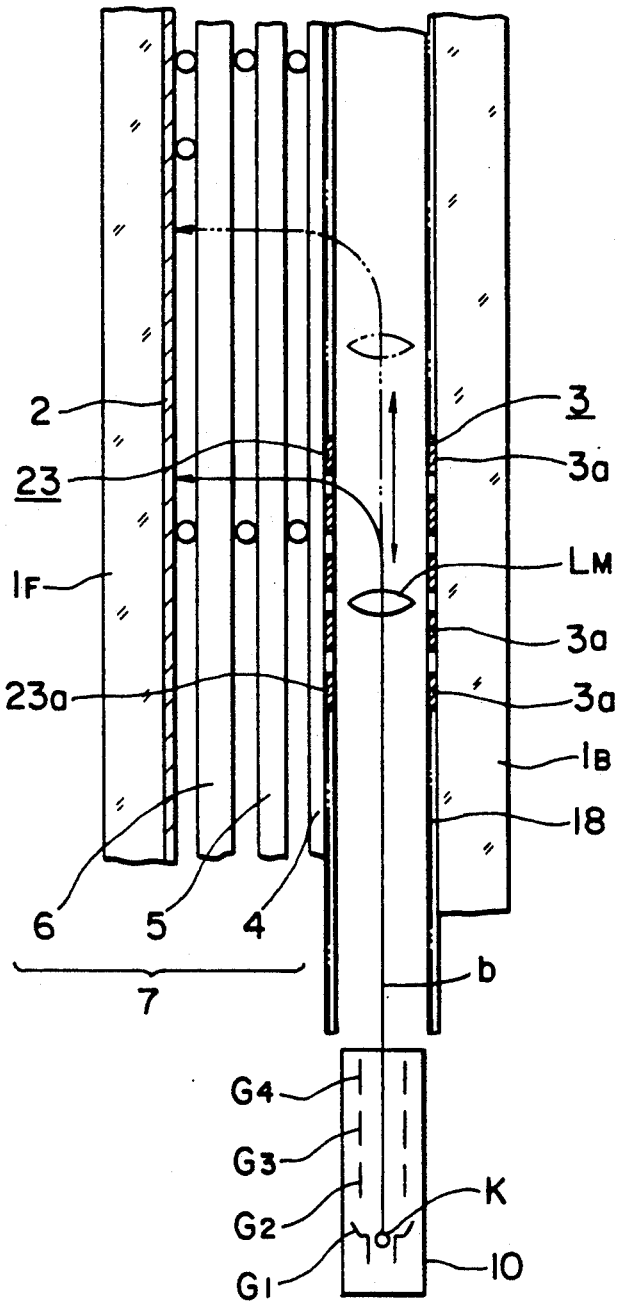
FIG. 3 is a schematic sectional view of the first embodiment in its vertical scanning direction.
Figure 4:
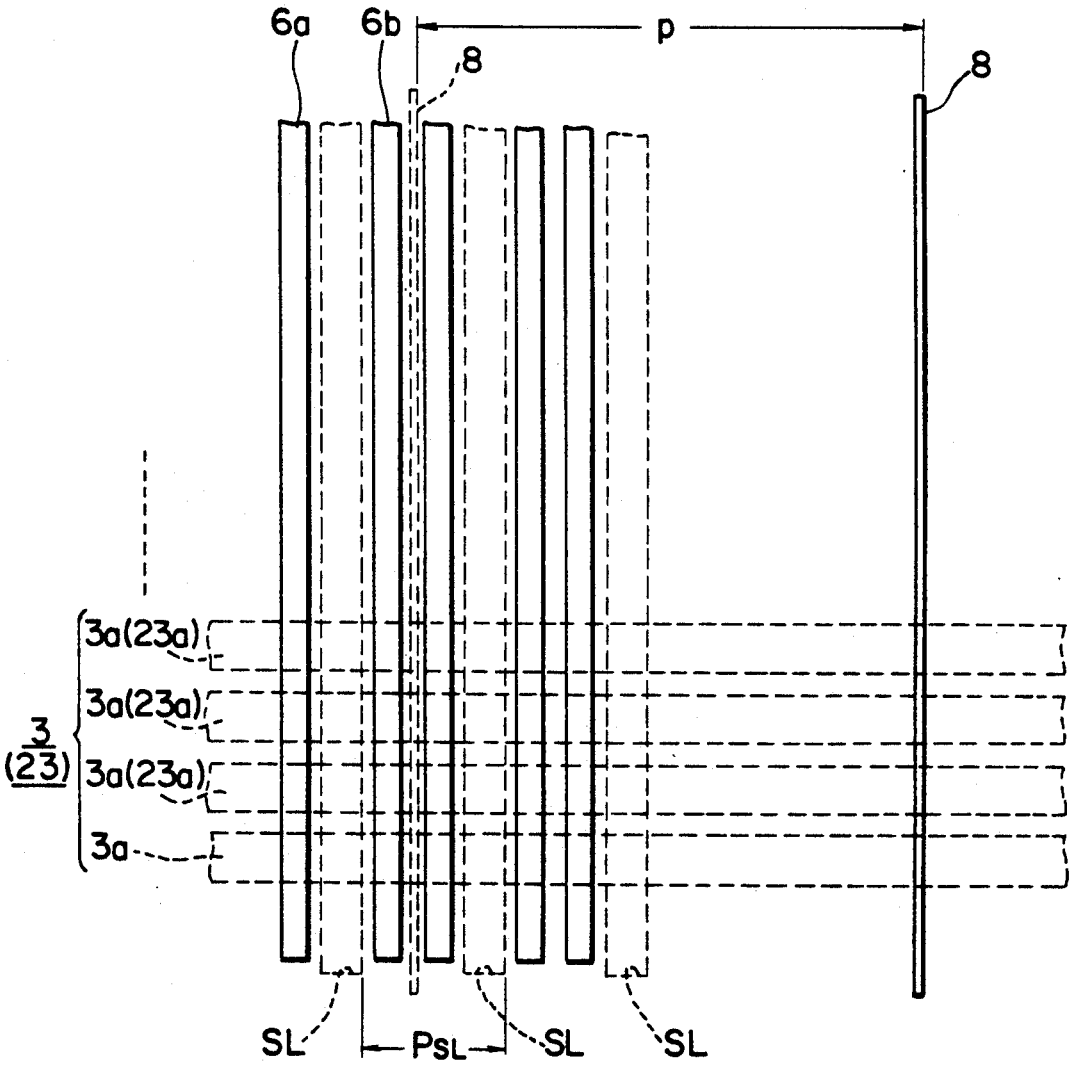
FIG. 4 illustrates a pattern of electrodes as viewed from the front in the first embodiment.
Figure 5:
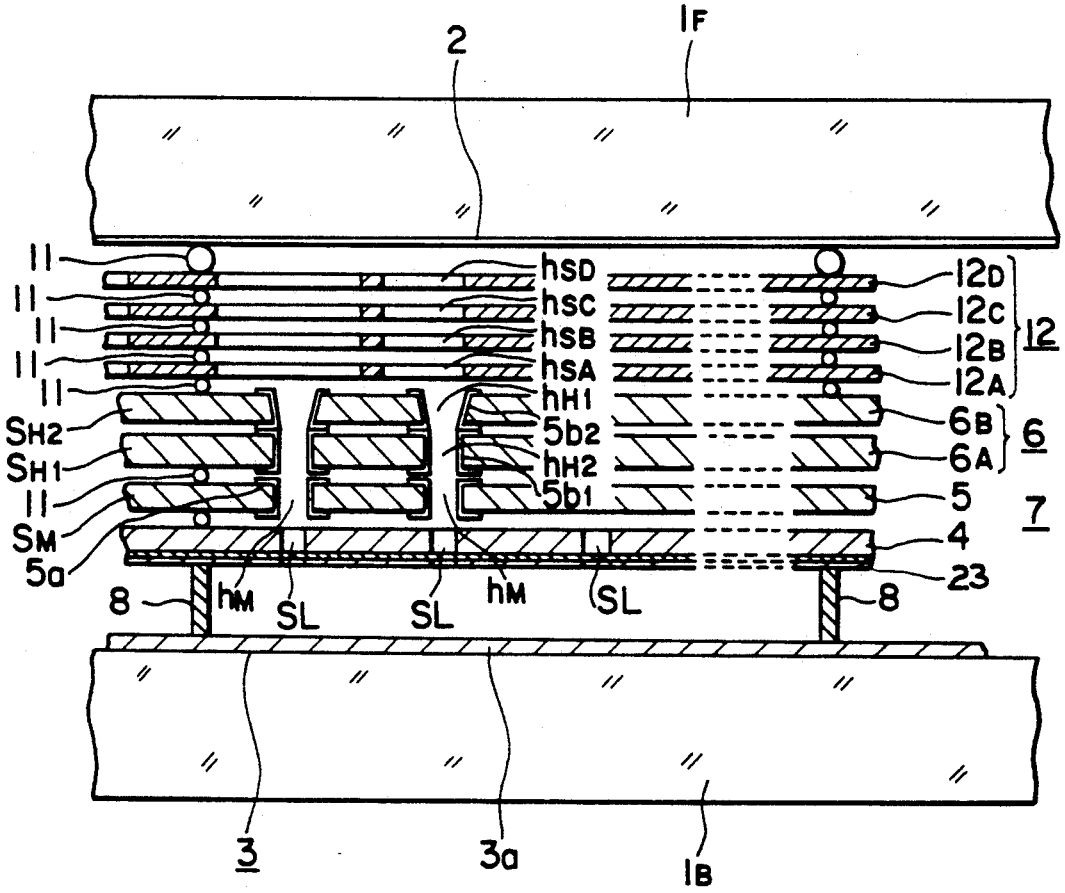
FIG. 5 is a schematic sectional view of principal components in the first embodiment electrode structure.

As illustrated in FIG. 3 together with a front-view electrode pattern of FIG. 4 and a sectional view of FIG. 5, the vertical deflecting electrode 3 comprises 480 to 525 parallel electrodes 3*a* corresponding numerically to vertical scanning lines. Such parallel electrodes 3*a* are composed of an evaporated metal film or a carbon film formed by screen printing and extend in the horizontal scanning direction, while maintaining a predetermined width and interval.

An electron gun 10 is provided with a positional deviation in the vertical scanning direction from a region opposite the fluorescent screen 2. The electron gun 10 has a common linear or band-like cathode K which is coated with a thermion emitting substance and extends in the horizontal scanning direction; and first through fourth grid electrodes G1–G4 are provided opposite to the cathode K and having slits which extend in the horizontal scanning direction respectively. The electron gun 10 is positioned so as to be opposite to the space between the electrode structure 7 and the vertical deflecting electrode 3.

In the electron gun 10, the electron beam b of thermions emitted from the cathode K never forms a crossover point and is introduced along the space between the electrode structure 7 and the vertical deflecting electrode 3 in the space of a sectionally linear or band-like laminar flow beam moved orthogonally to the surface of the panels 1F, 1B and along the horizontal scanning direction.

Meanwhile, between the fluorescent screen 2 and the vertical deflecting electrode 3 composed of parallel electrodes 3a, there are positioned an electrode structure 7 and high-resistance support walls 8 which are interposed between the electrode structure 7 and the back panel 1B.

The electrode structure 7 comprises at least an electron lens scanning electrode 23, a splitting electrode 4, a modulating electrode 5 and a horizontal deflecting electrode 6.

The electron lens scanning electrode 23 comprises parallel electrodes 23a which are provided correspondingly to the parallel electrodes 3a of the vertical deflecting electrode 3 and extend in the horizontal scanning direction. Such parallel electrodes 23a may be composed of rectangular metal plates or of a single insulator plate with a metal film deposited thereon and patterned by photoetching.

Figure 7:
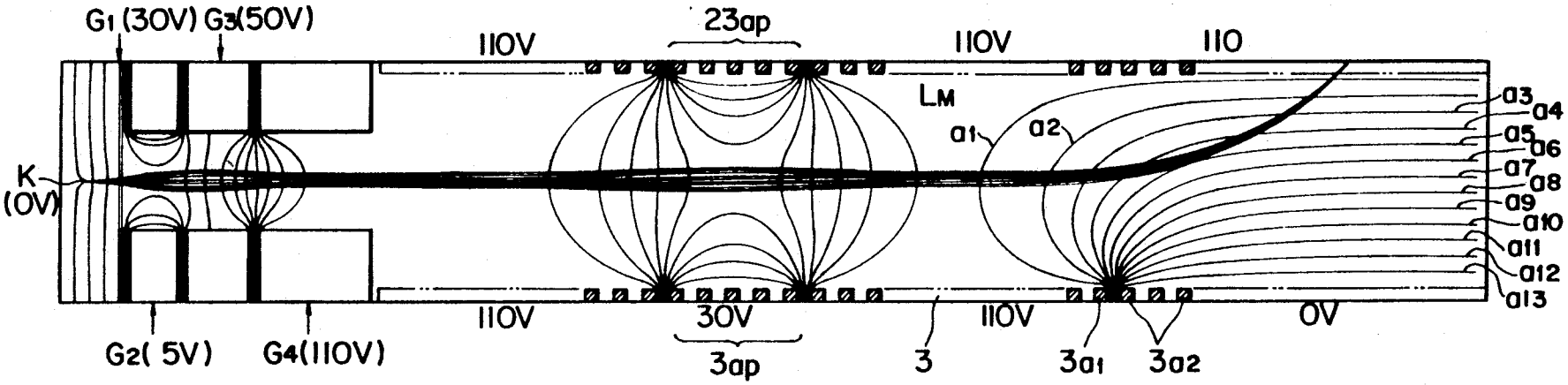
FIG. 7 illustrates an exemplary potential distribution of an electron gun in the first embodiment.

As illustrated in an exploded perspective view of FIG. 7 together with FIGS. 4 and 5, the splitting electrode 4 may be composed of electrode plates where a multiplicity of slits SL are arrayed in parallel to one another and extend in the vertical scanning direction at a predetermined pitch $P_{SL}$ of 2 mm for example.

The electron lens scanning electrode 23 is attached to the splitting electrode 4 by the use of an insulator bonding material such as glass frit.

Figure 6:
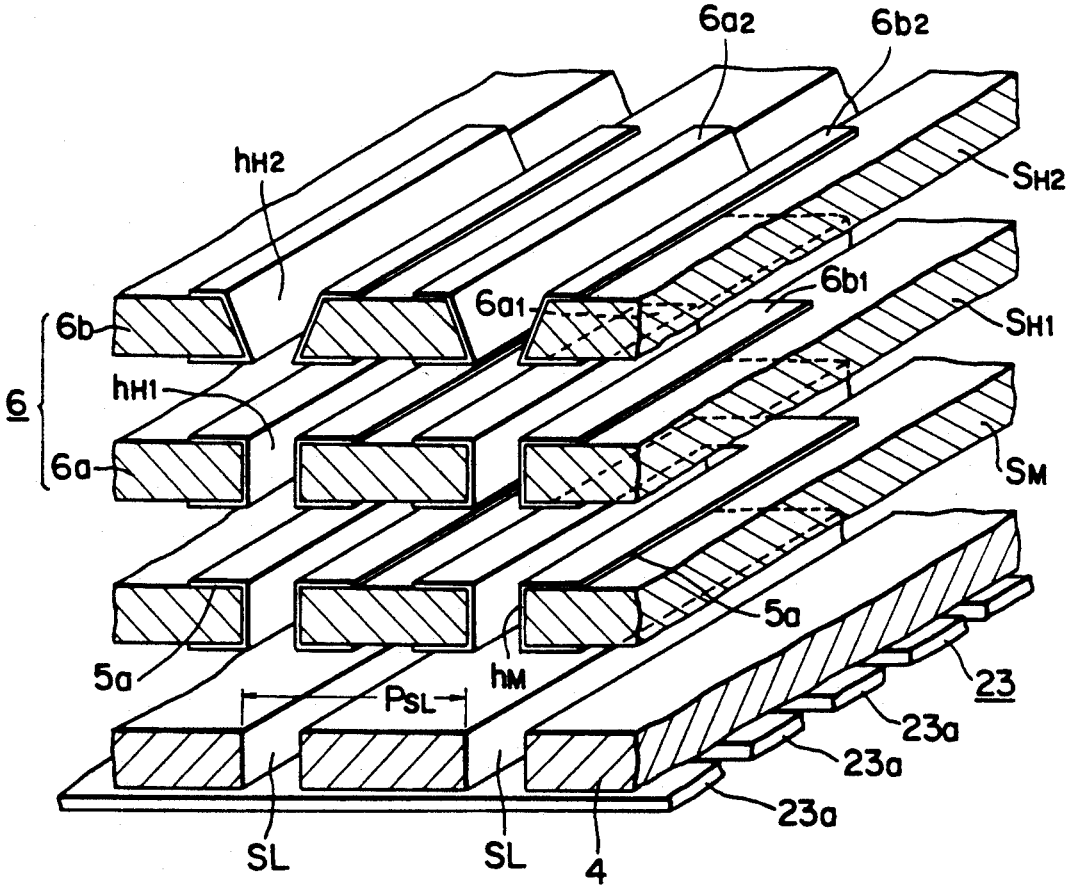
FIG. 6 is an exploded perspective view of principal components in the electrode structure of the first embodiment.

As shown in FIG. 6, in the modulating electrode 5, electrode conductive layers 5a are deposited on insulator substrates $S_M$ where slit-like electron beam passage holes $h_M$ are formed correspondingly to the slits SL in the splitting electrode 4. Such layers 5a are provided in the peripheries of the electron beam passage holes $h_M$ independently thereof.

As shown in FIG. 6, the horizontal deflecting electrode 6 is formed into a laminated structure composed of a plurality of plates as illustrated, wherein two electrode plates 6a and 6b are superimposed on each other. The electrode plates 6a and 6b include insulator substrates $S_{H1}$ and $S_{H2}$ having electron beam passage holes $h_{H1}$ and $h_{H2}$ formed correspondingly to the slits SL in the splitting electrode 4 and the electron beam passage holes $h_M$ in the modulating electrode 5. Pairs of conductive layers 6a1, 6b1 and 6a2, 6b2 are deposited on both sides correspondingly to the electron beam passage holes $h_{H1}$ and $h_{H2}$ respectively.

The insulator substrates $S_M$, $S_{H1}$ and $S_{H2}$ of the modulating electrode 5 and the horizontal deflecting electrode 6 are composed of photosensitive glass, and electron beam passage holes $h_M$, $h_{H1}$ and $h_{H2}$ are formed when such substrates are processed optically by exposure and development. And conductive layers 5a, 6a1, 6a2, 6b1, 6b2 of nickel or the like are formed in desired portions by electroless plating and electroplating.

As shown in FIG. 5, in the electrode structure 7, a shield electrode 12 may be disposed, when necessary, between the horizontal deflecting electrode 6 and the fluorescent screen 2. The shield electrode 12 is composed of a plurality (e.g., four) of metallic electrode plates 12A–12D, where electron beam passage holes $h_{SA}$–$h_{SD}$ are formed correspondingly to the electron beam selection holes $h_{H2}$.

Insulator balls 11 such as glass beads are interposed among the electrodes to be electrically isolated from one another in the electrode structure 7, e.g., among the sequentially adjacent splitting electrode 4, modulating electrode 5, horizontal deflecting electrode 6 and shield electrode 12; and further among the individual electrodes 12A–12D of the shield electrode 12. Such insulator balls 11 are interposed also between the electrode structure 7 and the front panel 1F so as to retain a required distance. High-resistance support walls 8 having a predetermined low electric conductivity are fixed upright between the electrode structure 7 and the back panel 1B at a pitch P of 10 to 20 mm among groups of a plurality of slits SL in such a manner as to be perpendicular to the front panel 1F and the back panel 1B and to be along the vertical scanning direction. Due to the existence of such high-resistance support walls 8 between the electrode structure 7 and the back panel 1B, the space between the front panel 1F and the back panel 1B can be retained at a predetermined value with a sufficiently high withstanding strength against any external pressure, such as atmospheric pressure.

The high-resistance support walls 8 are composed entirely of metal oxide such as ceramic plate having high electric resistance, or of insulator substrates coated with a high-resistance material.

On the fluorescent screen 2, several groups of striped red, green and blue fluorescent triplets are provided with respect to each beam passage hole $h_{SO}$.

In the above construction, DC voltages of 30 V, −5 V, 50 V, 110 V are applied respectively to the first, second, third and fourth grids G1, G2, G3, G4 with respect to the cathodes K of the electron gun 10.

FIG. 7 illustrates the focused and deflected state of the laminar-flow electron beam b caused by the electric fields of the electron gun 10, the vertical deflecting electrode 3 and the electron lens scanning electrode 23. The cross-sectional shape of the beam orthogonal to the drawing paper face of FIG. 7, i.e., orthogonal to the panels 1B, 1F is band-like or linear along the horizontal scanning direction.

In this case, a voltage of 110 V is applied to the splitting electrode 4 and the parallel electrodes 23a of the electron lens scanning electrode 23 with the exception of some partial parallel electrodes 23a which will be described later.

As shown in FIG. 7, between the mutually adjacent electrodes 3a1 and 3a2 located correspondingly to the predetermined vertical scanning positions with respect to the parallel electrodes 3a of the vertical deflecting electrode, a voltage of 110 V, which is equal to that at the splitting electrode 4, is applied to the electrodes 3a positioned closer to the electron gun 10 than the electrode 3a1, except for some partial electrodes 3aF which will be described later, while a voltage of 0 V is applied to the entire electrodes positioned on the reverse side of the electron gun 10 from the electrode 3a2. The position for applying the voltage difference is sequentially shifted in the vertical scanning direction synchronously with the vertical scanning speed and period. Then, in the vicinity of the electrodes 3a1 and 3a2 to which a potential difference of 110 V is applied, the beam b is deflected by the electric field represented by equipotential lines a1, a2, a3 . . . in FIG. 7, and thus the beam b is introduced into the slits SL extending in the horizontal scanning direction in the splitting electrode 4, while the slit positions are vertically scanned. And a single beam spot composed of the beam from the electron gun 10 is split into a plurality of beams in conformity with the number of the slits SL.

In the present invention, a focusing lens system $L_M$ for the electron beam b is formed by the cooperation of the vertical deflecting electrode 3 and the electron lens scanning electrode 23 in the stage anterior to the vertical deflecting electric field. Namely, a unipotential electron lens $L_B$ can be formed by applying a required voltage to the mutually adjacent partial parallel electrodes 3ap spaced apart by predetermined distances from the electrode 3a1 out of the electrodes 3a positioned closer to the electron gun 10 than the aforementioned electrode 3a1 of the vertical scanning deflecting electrode 3, and also to the parallel electrodes 23ap of the electron lens scanning electrode 23 opposed to such mutually adjacent parallel electrodes 3ap. The required voltage thus applied is, e.g., 30 V, which is lower than the voltage 110 V at the electrodes 3a and 23a on both sides of the above-described partial parallel electrodes. The electron lens $L_M$ is moved synchronously with the aforementioned shift of the vertical deflecting electric field in the same direction as such shift in a manner so as to maintain the image magnification constant relative to the electron beam b.

Thus, the focusing lens $L_M$ can be formed in the vertical deflection region where the electron beam is prone to spread at the position far from at least the electron gun 10, i.e., where the trajectory distance of the electron beam b is long, thereby preventing spreading of the electron beam. Furthermore, the ratio of the distance a between the image point and the lens system $L_M$ to the distance b between the lens system $L_M$ and the image focus point on the fluorescent screen 2 can be rendered substantially constant in any portion by the dynamic motion of the focusing lens system synchronized with the vertical scanning, so that a desired uniform focus state can be attained.

A voltage of 200 V for example is applied to the modulating electrode 5 for enabling the same to focus the split beams, and a pulse-width modulation voltage corresponding to a display signal is applied to electrode conductive layers 5a which are disposed around the peripheries of the electron beam passage holes $h_M$ respectively.

A deflecting voltage of 300±100 V, for example, is applied between the pairs of deflecting electrode conductive layers 6a1, 6b1 and 6a2, 6b2 provided correspondingly to the beam passage holes so that the horizontal deflecting electrode 6 sequentially deflects in synchronism with the horizontal scanning of the fluorescent screen areas such as a plurality of groups of red, green and blue triplets which are formed correspondingly to the beam passage holes. Thus, a fine horizontal deflection is performed to deflect the individual beams split through the slits SL in the splitting electrode 4.

A high voltage of 10 kV or so is applied to the fluorescent screen 2, while voltages raised toward the electrode plate proximate to the fluorescent screen 2, such as 2 kV, 4 kV, 6 kV, 8 kV, are applied respectively to the electrode plates 12A–12D of the shield electrode 12 to thereby shield the horizontal deflecting electrode 6 and the modulating electrode 5 from the high voltage.

Figure 1:
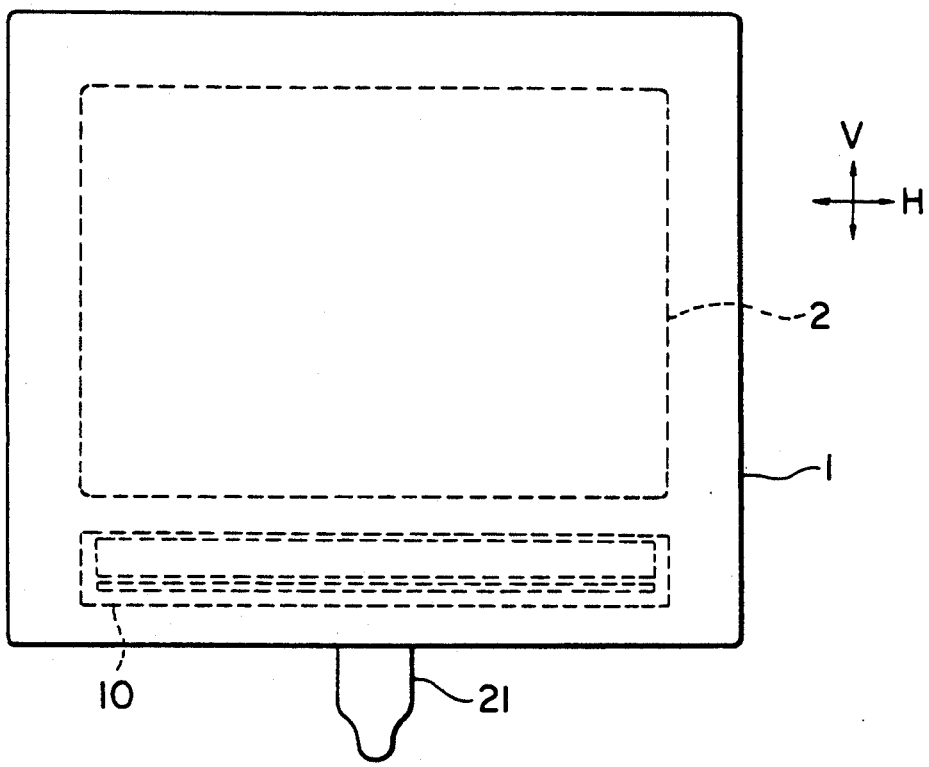
FIG. 1 is a front view of a first and second embodiment of a planar display apparatus embodying the present invention.
Figure 2:
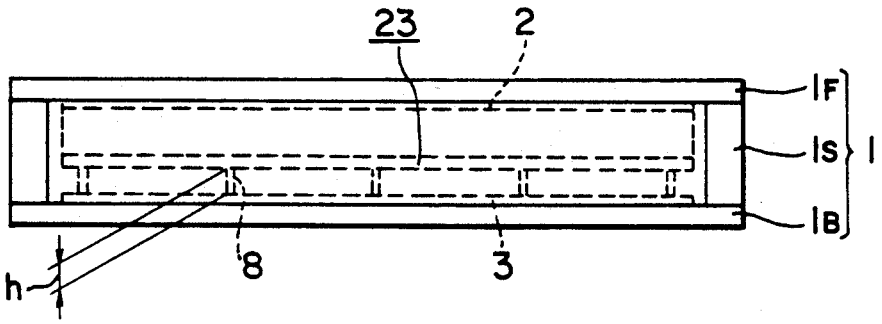
FIG. 2 is a side view of the first embodiment shown in FIG. 1.

Now a description will be given of a second embodiment of the present invention. Reference numerals are similar to those of the first embodiment but have prime marks. FIG. 1 previously described, applies to both the first and second embodiments.

Figure 12:
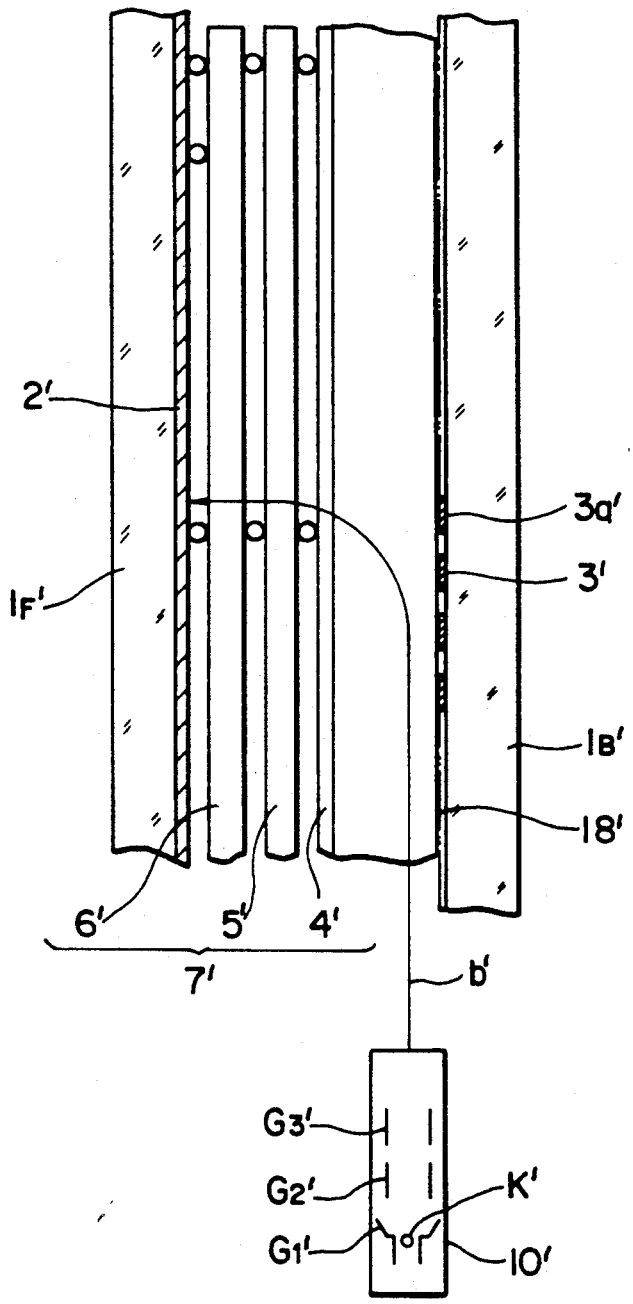
FIG. 12 is a schematic sectional view of such a second embodiment shown in FIG. 11 in its vertical scanning direction.

With reference to FIG. 12, which is a sectional view in the vertical scanning direction, vertical deflecting electrode 3' comprises 480 to 525 parallel electrodes 3a' corresponding numerically to vertical scanning lines. Such parallel electrodes 3a' are composed of an evaporated metal film or a carbon film formed by screen printing, and extend in the horizontal scanning direction while maintaining a predetermined width and interval.

An electron gun 10' is disposed with a positional deviation in the vertical scanning direction from an opposite portion to the fluorescent screen 2'. The electron gun 10' has a common linear or band-like cathode K' which is coated with a thermion emitting substance and extends in the horizontal scanning direction. First, second and third grid electrodes G1', G2', G3' are provided opposite to the cathode K' and which have slits which extend in the horizontal scanning direction respectively. The electron gun 10' is so positioned as to be opposite to the space between the electrode structure 7' and the vertical deflecting electrode 3'.

Figure 13:
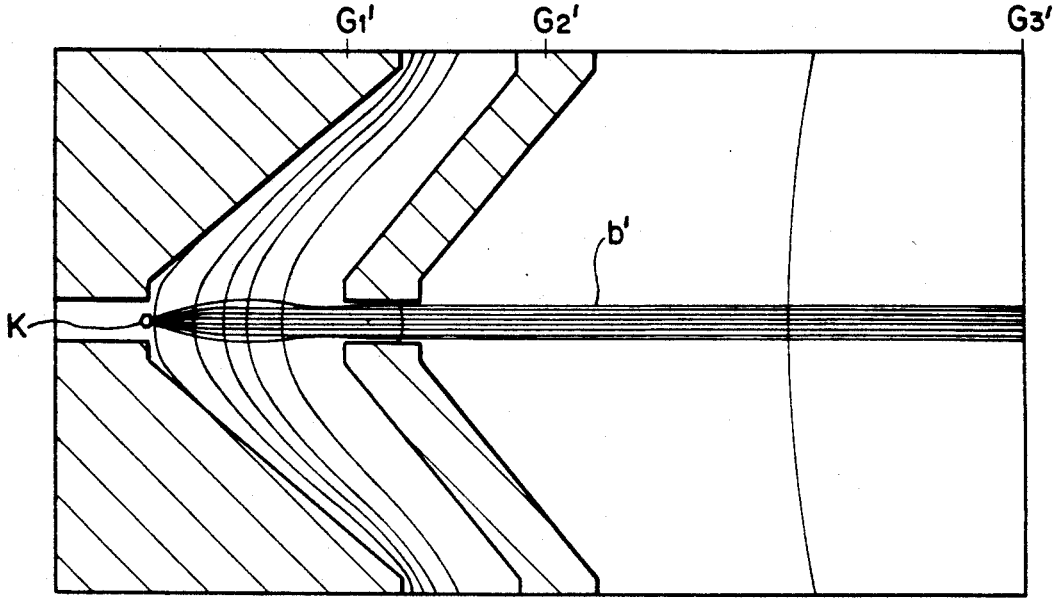
FIG. 13 illustrates an exemplary potential distribution of an electron gun for the second embodiment.

FIG. 13 illustrates a potential distribution of the electron gun 10' for the second embodiment and a laminar flow of the electron beam b' formed by such a potential distribution. The electron beam orthogonal to the paper face of FIG. 13, i.e., orthogonal to the panels 1B', 1F' and along the horizontal scanning direction, is sectionally shaped to be linear or band-like.

Meanwhile, for the second embodiment as shown in FIG. 12, between the fluorescent screen 2' and the vertical deflecting electrode 3' composed of parallel electrodes 3a', there are positioned an electrode structure 7' and high-resistance support walls 8' (FIG. 11—and also designed like the walls 8 shown in the first embodiment—FIG. 5) which are interposed between the electrode structure 7' and the back panel 1B'. The electrode structure 7' comprises at least a splitting electrode 4', a modulating electrode 5' and a horizontal deflecting electrode 6'.

Figure 14:
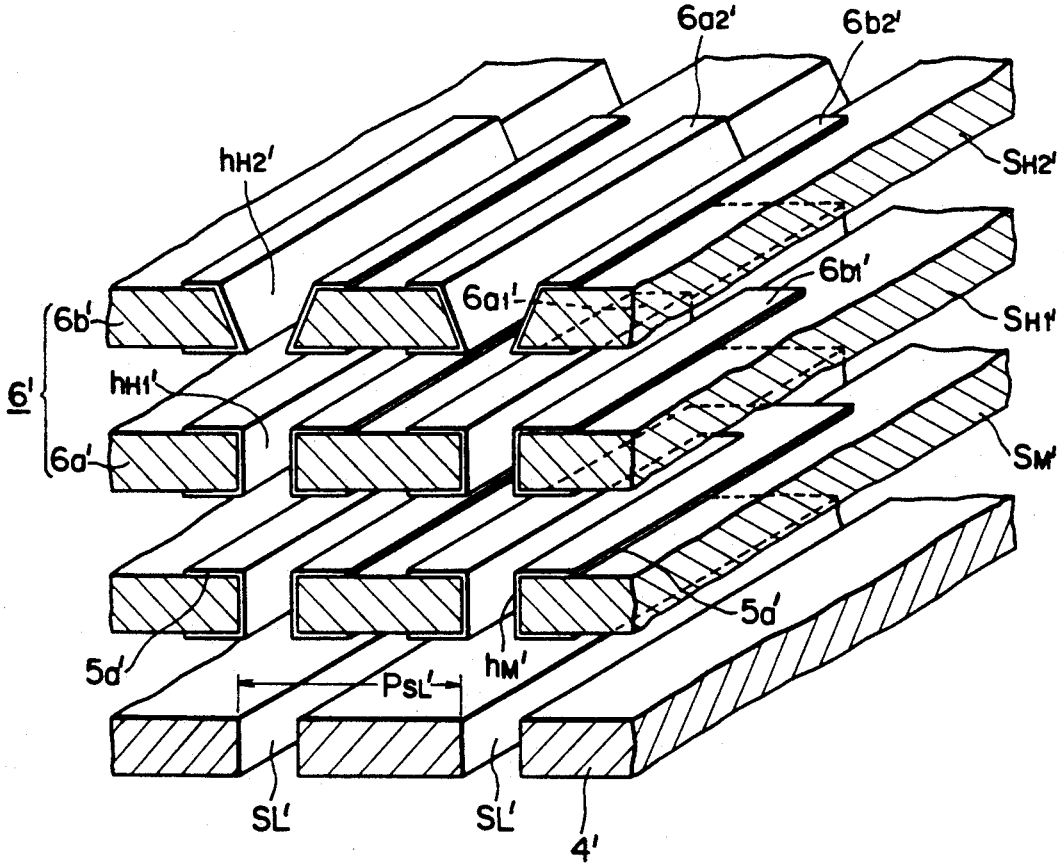
FIG. 14 is an exploded perspective view of principal components in the electrode structure for the second embodiment.

As illustrated for the second embodiment in an exploded perspective view of FIG. 14, the splitting electrode 4' may be composed of electrode plates where a multiplicity of slits SL' are arrayed in parallel to one another and extend in the vertical scanning direction at a predetermined pitch $P_{SL}'$ of 2 mm for example.

In the modulating electrode 5', electrode conductive layers 5a' are deposited on insulator substrates $S_M'$ where slit-like electron beam passage holes $h_M'$ are formed correspondingly to the slits SL' in the splitting electrode 4'. Such layers 5a are provided in the peripheries of the electron beam passage holes $h_M'$ independently thereof.

The horizontal deflecting electrode 6' is formed into a laminated structure composed of a plurality of plates as illustrated, wherein two electrode plates 6a' and 6b' are superimposed on each other. The electrode plates 6a' and 6b' include insulator substrates $S_{H1}'$ and $S_{H2}'$ having electron beam passage holes $h_{H1}'$ and $h_{H2}'$ formed correspondingly to the slits SL' in the splitting electrode 4' and the electron beam passage holes $h_M'$ in the modulating electrode 5'. Pairs of conductive layers 6a1', 6b1' and 6a2', 6b2' are deposited on both sides correspondingly to the electron beam passage holes $h_{H1}'$ and $h_{H2}'$ respectively.

The insulator substrates $S_M'$, $S_{H1}'$ and $S_{H2}'$ of the modulating electrode 5' and the horizontal deflecting electrode 6' are composed of photosensitive glass, and electron beam passage holes $h_M'$, $h_{H1}'$ and $h_{H2}'$ are formed when such substrates are processed optically by exposure and development. Conductive layers 5a', 6a1', 6a2', 6b1', 6b2' of nickel or the like are formed in desired portions by electroless plating and electroplating.

In the electrode structure 7', a shield electrode 12 of the type shown in FIG. 5 for the first embodiment may be disposed, when necessary, between the horizontal deflecting electrode 6' and the fluorescent screen 2'.

As shown for the first embodiment in FIG. 5, insulator balls 11 such as glass beads are interposed among the electrodes to be electrically isolated from one another as discussed in connection with the first embodiment.

Figure 11:
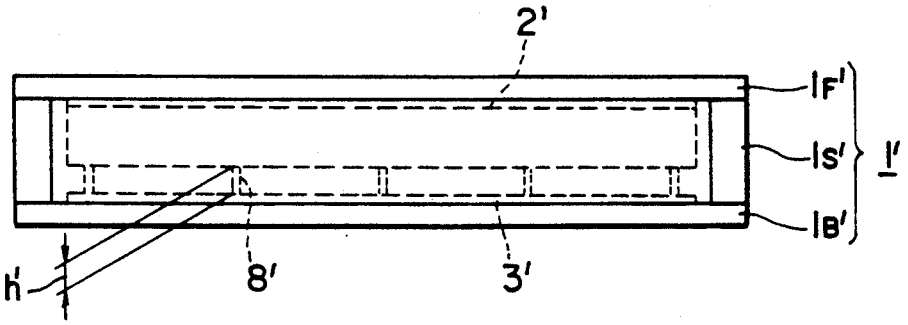
FIG. 11 is a side view of a second embodiment of a planar display apparatus embodying the present invention.

The high-resistance support walls 8' shown in FIG. 11 have a predetermined low electric conductivity and are fixed upright between the electrode structure 7' and the back panel 1B'. The structure and makeup of these support walls 8' was already discussed in connection with the first embodiment, particularly as shown in FIG. 5.

On the fluorescent screen 2', several groups of striped red, green and blue fluorescent triplets are provided with respect to each beam passage hole.

Figure 15:
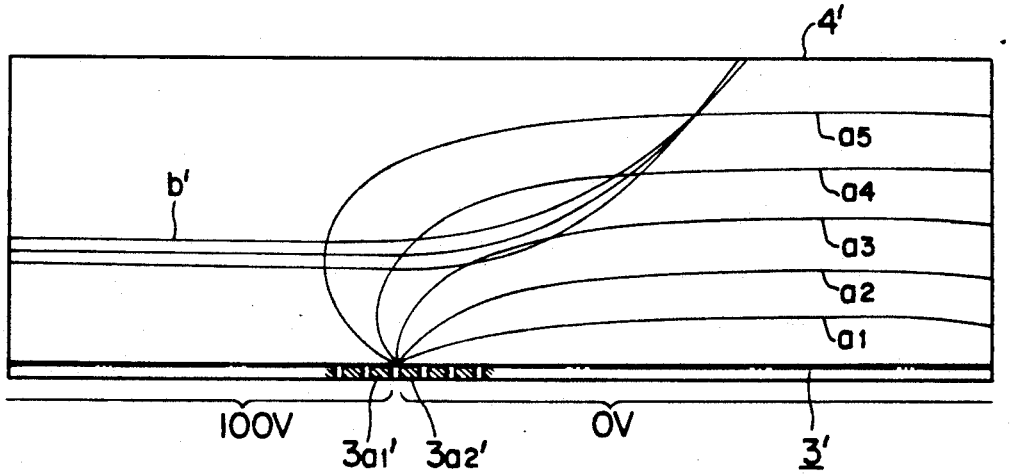
FIG. 15 illustrates a potential distribution in a deflected state of an electron beam in the second embodiment.

In the above construction of the second embodiment, a required positive DC voltage, which gradually increases toward the grid electrode G3' with respect to the cathode K' of the electron gun 10', is applied to the first through third grid electrodes G1'-G3'. For example, a voltage of 100 V is applied to the third grid electrode G3', the splitting electrode 4' and some parallel electrodes 3a' of the vertical deflecting electrode 3'. In this case, between the mutually adjacent electrodes 3a1' and 3a2' (see FIG. 15) located correspondingly to the predetermined vertical scanning positions with respect to the parallel electrodes 3a' of the vertical deflecting electrode, a voltage of 100 V, which is equal to that at the splitting electrode 4', is applied to the entire electrodes 3a' positioned closer to the electron gun 10' than the electrode 3a1', while a voltage of 0 V is applied to the entire electrodes positioned on the reverse side of the electron gun 10' from the electrode 3a2', and the position for applying the voltage difference is sequentially shifted in the vertical scanning direction synchronously with the vertical scanning speed and period. Then, in the vicinity of the electrodes 3a1' and 3a2' to which a potential difference of 100 V is applied, the beam b' is deflected by the electric field represented by equipotential lines a1, a2, a3 . . . in FIG. 15, and thus the beam b' is introduced into the slits SL' extending in the horizontal scanning direction in the splitting electrode 4', while the slit positions are vertically scanned. A single beam spot composed of the beam b' from the electron gun 10' is split into a plurality of beams in conformity with the number of the slits SL'.

A voltage of 200 V for example is applied to the modulating electrode 5' for enabling the same to focus the split beams, and a pulse-width modulation voltage corresponding to a display signal is applied to electrode conductive layers 5a' which are disposed around the peripheries of the electron beam passage holes $h_M'$ respectively.

A deflecting voltage of 300±100 V for example is applied between the pairs of deflecting electrode conductive layers 6a1', 6b1' and 6a2', 6b2' provided correspondingly to the beam passage holes so that the horizontal deflecting electrode 6' sequentially deflects, in synchronism with the horizontal scanning, across the fluorescent screen areas such as a plurality of groups of red, green and blue triplets which are formed correspondingly to the beam passage holes, whereby a fine horizontal deflection is performed to deflect the individual beam split through the slits SL' in the splitting electrode 4'.

A high voltage of 10 kV or so is applied to the fluorescent screen 2', while voltages raised toward the electrode plate proximate to the fluorescent screen 2', such as 2 kV, 4 kV, 6 kV, 8 kV, are applied respectively to the electrode plates 12A-12D of the shield electrode 12 (the shield electrode shown in FIG. 5 relative to the first embodiment also may be employed in the second embodiment as explained previously), to thereby shield the horizontal deflecting electrode 6' and the modulating electrode 5' from the high voltage.

According to either the first or second embodiment of the present invention as described hereinabove, a single laminar flow beam b is used to excite the entire area of the fluorescent screen 2. However, in case a sufficiently high beam density or a sufficiently great anode current is not attainable, it is permitted to dispose a secondary electron multiplier means between the horizontal deflecting electrode 6 and the modulating electrode 5 in either the first or second embodiment (the second embodiment reference numerals being designated by '''''').

Figure 8:
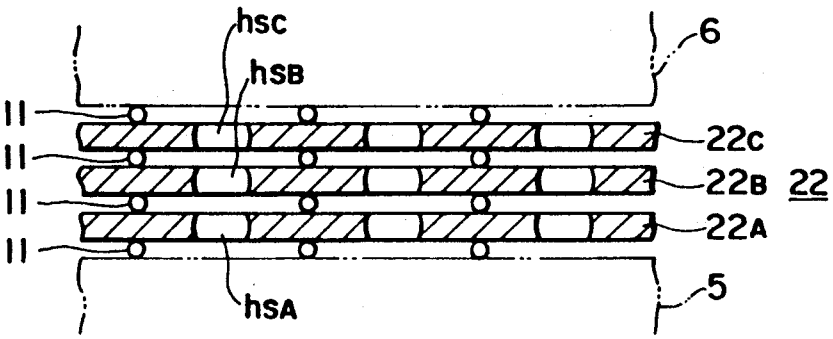
FIG. 8 is a schematic sectional view of an exemplary secondary electron multiplier means for the first or second embodiments.

For example, the secondary electron multiplier means 22 comprises a plurality of electrode plates 22A, 22B, 22C as shown in a sectional view of FIG. 8, wherein electron beam passage holes $h_{SA}$, $h_{SB}$, $h_{SC}$ are formed correspondingly to slits SL, and a great amount of secondary electrons are generated by the impingement of magnesium electrons or the like upon the inner surfaces of such holes. If the beam passage holes $h_{SA}$, $h_{SB}$ are coated with a suitable substance having a high secondary electron emission rate, the electrons introduced into such holes are so activated that multiplied secondary electrons are produced and moved toward the fluorescent screen 2. In this case, it is preferred that voltages applied to the electrode plates 22A, 22B, 22C of the secondary electron multiplier means become sequentially higher toward the fluorescent screen 2. Insulator balls 11 such as glass beads may be disposed between the electrode plates.

Figure 9:
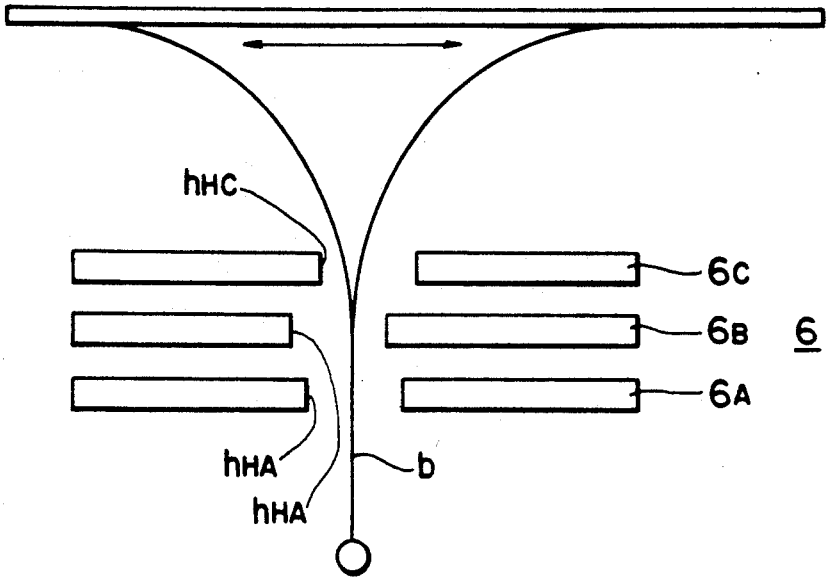
FIG. 9 shows another exemplary electrode structure in a horizontal deflecting electrode for the first or second embodiments.
Figure 10:
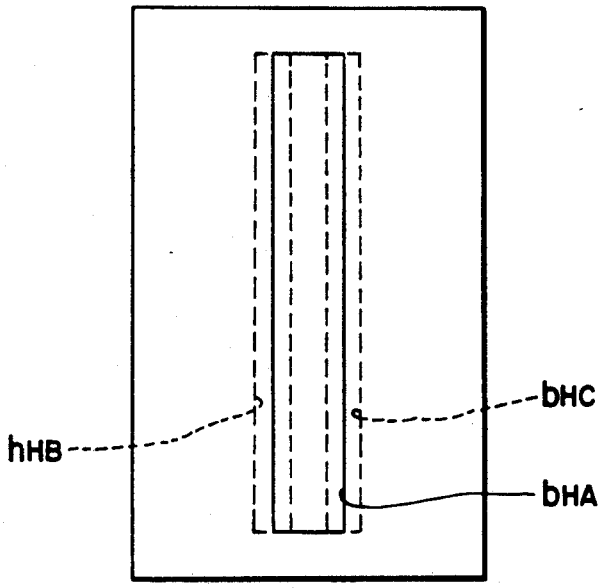
FIG. 10 illustrates the positional relationship of electron beam passage holes in the structure of FIG. 9 for the first or second embodiments.

It is to be understood that the present invention is not limited to the above embodiments alone. For example, in either the first or second embodiment, the horizontal deflecting electrode 6 may be so formed as illustrated in a sectional view of FIG. 9 and the front view of FIG. 10, wherein three electrode plates 6A-6C are provided to be electrically independent of one another, and electron beam passage holes $h_{HA}$-$h_{HC}$ are made positionally eccentric leftward and rightward with the hole $h_{HA}$ being set at the center, and each split beam $b_S$ being slightly deflected with a high resolution by the application of a horizontal deflecting voltage to the electrode plate 6B.

In the first embodiment, the parallel electrodes 23*a* of the electron lens scanning electrode 23 are numerically equal to the parallel electrodes 3*a* of the vertical deflecting electrode 3. However, a plurality of the parallel electrodes 3*a* may be grouped, and the electrodes 23*a* may be provided corresponding to such groups.

Although a unipotential electron lens $L_M$ is formed in the above embodiment, it may be replaced with a bipotential type or the like as well.

Thus, in the planar display apparatus of the present invention using a single electron beam b which is sectionally bandlike or linear, brightness nonuniformity can be averted as compared with an ordinary apparatus where beams from a plurality of cathodes are assigned to individual portions of the fluorescent screen. Furthermore, due to the feature of forming a focusing lens and dynamically moving such a focusing lens in synchronism with the vertical scanning, a uniform image quality can be achieved, even in the large-screen display apparatus.

In addition, since the space between the front panel 1F and the back panel 1B is retained by the high-resistance support walls 8 disposed so that the plate surfaces thereof extend in the vertical scanning direction between the electrode structure 7 and the back panel 1B, such support walls 8 cause no impediment to the passages of the electron beam b moved from the electron gun 10 toward the fluorescent screen 2. As the support walls 8 are composed of high-resistance material, the potential difference between the vertical deflecting electrode 3 and the electrode structure 7 in contact with the support walls 8 is distributed so as to become gradually uniform in the direction of the height h of the support walls 8, whereby any disorder of the electric field can be averted to eventually eliminate disorder of the electron beams, despite the existence of such support walls.

Although various minor changes and modifications might be proposed by those skilled in the art, it will be understood that we wish to include within the claims of the patent warranted hereon all such changes and modifications as reasonably come within our contribution to the art.

We claim:

1. A planar display apparatus, comprising:

a planar tube body with a fluorescent screen formed on an inner surface of a front panel thereof;

an electron gun disposed at a position deviated in a vertical scanning direction from a region opposite to said fluorescent screen;

a vertical deflection electrode assembly comprising a plurality of parallel electrodes each extending in a horizontal scanning direction and disposed opposite to said fluorescent screen and on a side of a back panel opposed to the front panel of said planar tube body;

an electrode structure disposed in said region opposite to said fluorescent screen between said vertical deflecting electrode assembly and said fluorescent screen, said electrode structure including at least an electron lens scanning electrode assembly spaced from said vertical deflecting electrode assembly at a side towards said fluorescent screen and comprising a plurality of parallel and co-planar electrodes each extending in said horizontal scanning direction and parallel to and in alignment with said vertical deflection electrodes, a splitting electrode means adjacent said scanning electrode assembly at a side towards said fluorescent screen including a plurality of parallel and co-planar electrodes each running in said vertical scanning direction for splitting an electron beam from said electron gun into a plurality of beams, a modulating electrode assembly adjacent said splitting electrode means at a side towards said fluorescent screen comprising a plurality of parallel co-planar modulating electrodes each running in said vertical scanning direction and thus parallel to and in alignment with said splitting electrodes, and a horizontal deflecting electrode assembly adjacent said modulating electrode assembly at a side towards said fluorescent screen comprising a plurality of parallel horizontal electrodes in alignment with and each running parallel to said modulating electrodes and splitting electrodes in said vertical scanning direction;

high resistance support walls interposed between said electrode structure and said back panel and which are positioned and dimensioned to press said electrode structure towards said front panel to thereby retain a space between said front and back panels; and said electron gun having means for emitting the electron beam into said region opposite said fluorescent screen and between said electrode structure and said vertical deflecting electrode assembly as a band-like electron beam which is substantially parallel to said front and back panels, a width of said band extending in said horizontal scanning direction and said electron beam being emitted into said region opposite said fluorescent screen in said vertical scanning direction.

2. An apparatus according to claim 1 wherein said plurality of parallel horizontal deflection electrodes are divided into two layers of electrodes running parallel to one another.

3. An apparatus according to claim 1 wherein a shield electrode assembly is further provided between said electrode structure and said fluorescent screen.

4. An apparatus according to claim 3 wherein said shield electrode assembly comprises a plurality of electrode plates one above the other.

5. An apparatus according to claim 1 wherein said support walls are formed such that they extend in said vertical scanning direction and plate surfaces thereof are orthogonal to planar surfaces of said front and back panels.

6. An apparatus according to claim 1 wherein in a direction toward said fluorescent screen, the modulating electrode assembly directly follows the splitting electrode assembly, and the horizontal deflecting electrode assembly directly follows the modulating electrode assembly.

7. An apparatus according to claim 1 wherein a secondary electron multiplier means for increasing at least one of beam density or anode current is disposed between the horizontal deflecting electrode assembly and the modulating electrode assembly.

8. An apparatus according to claim 1 wherein the horizontal deflecting electrode assembly comprises three electrode plates which are electrically independent of one another.

9. A planar display apparatus, comprising:

a planar tube body with a fluorescent screen formed on an inner surface of a front panel thereof;

an electron gun disposed at a position deviated in a vertical scanning direction from a region opposite to said fluorescent screen;

a vertical deflection electrode assembly comprising a plurality of parallel electrodes each extending in a horizontal scanning direction and disposed opposite to said fluorescent screen and on a side of a back panel opposed to the front panel of said planar tube body;

an electrode structure disposed in said region opposite to said fluorescent screen between said vertical deflecting electrode assembly and said fluorescent screen, said electrode structure including at least an electron lens scanning electrode assembly spaced from said vertical deflecting electrode assembly at a side towards said fluorescent screen comprising a plurality of parallel electrodes each extending in said horizontal scanning direction and parallel to and in alignment with said vertical deflection electrodes, a splitting electrode means adjacent said scanning electrode assembly at a side towards said fluorescent screen for splitting an electron beam from said electron gun into a plurality of beams, a modulating electrode assembly adjacent said splitting electrode means at a side towards said fluorescent screen, and a horizontal deflecting electrode assembly adjacent said modulating electrode assembly at a side towards said fluorescent screen;

high resistance support walls interposed between said electrode structure and said back panel and which are positioned and dimensioned to press said electrode structure towards said front panel to thereby retain a space between said front and back panels; and said electron gun having means for emitting the electron beam into said region opposite said fluorescent screen and between said electrode structure and said vertical deflecting electrode assembly as a band-like electron beam which is substantially parallel to said front and back panels, a width of said band extending in said horizontal scanning direction and said electron beam being emitted into said region opposite said fluorescent screen in said vertical scanning direction.

10. A planar display apparatus, comprising:

a planar tube body with a fluorescent screen formed on an inner surface of a front panel thereof;

an electron gun disposed at a position deviated in a vertical scanning direction from a region opposite to said fluorescent screen;

a vertical deflection electrode assembly comprising a plurality of parallel electrodes each extending in a horizontal scanning direction and disposed opposite to said fluorescent screen and on a side of a back panel opposed to the front panel of said planar tube body;

an electrode structure disposed in said region opposite to said fluorescent screen between said vertical deflecting electrode assembly and said fluorescent screen, said electrode structure including at least a splitting electrode means spaced from said vertical deflecting electrode assembly at a side towards said fluorescent screen including a plurality of parallel and co-planar electrodes each running in said vertical scanning direction for splitting an electron beam from said electron gun into a plurality of beams, a modulating electrode assembly directly following the splitting electrode means at a side towards said fluorescent screen comprising a plurality of parallel and co-planar modulating electrodes each running in said vertical scanning direction and thus parallel to and in alignment with said splitting electrodes, and a horizontal deflecting electrode assembly directly following the modulating electrode assembly at a side towards said fluorescent screen and comprising a plurality of parallel horizontal electrodes in alignment with and each running parallel to said modulating electrodes and splitting electrodes in said vertical scanning direction;

high resistance support walls interposed between said electrode structure and said back panel and which are positioned and dimensioned to press said electrode structure towards said front panel to thereby retain a space between said front and back panels; and said electron gun having means for emitting the electron beam into said region opposite said fluorescent screen and between said electrode structure and said vertical deflecting electrode assembly as a band-like electron beam which is substantially parallel to said front and back panels, a width of said band extending in said horizontal scanning direction and said electron beam being emitted into said region opposite said fluorescent screen in said vertical scanning direction.

11. An apparatus according to claim 10 wherein said plurality of parallel horizontal deflection.

12. An apparatus according to claim 10 wherein a shield electrode assembly is further provided between said electrode structure and said fluorescent screen.

13. An apparatus according to claim 12 wherein said shield electrode assembly comprises a plurality of electrode plates one above the other.

14. An apparatus according to claim 10 wherein said support walls are formed such that they extend in said vertical scanning direction and plate surfaces thereof are orthogonal to planar surfaces of said front and back panels.

15. An apparatus according to claim 10 wherein a secondary electron multiplier means for increasing at least one of beam density or anode current is disposed between the horizontal deflecting electrode assembly and the modulating electrode assembly.

16. An apparatus according to claim 10 wherein the horizontal deflecting electrode assembly comprises three electrode plates which are electrically independent of one another.

* * * * *